US006464224B1

(12) United States Patent
Wusterbarth

(10) Patent No.: US 6,464,224 B1
(45) Date of Patent: Oct. 15, 2002

(54) BOARD GAME

(76) Inventor: Daniel R Wusterbarth, 1110 6th St., Kiel, WI (US) 53042

( * ) Notice: Subject to any disclaimer, the term of this patent is extended or adjusted under 35 U.S.C. 154(b) by 0 days.

(21) Appl. No.: 09/299,210

(22) Filed: Apr. 26, 1999

(51) Int. Cl.[7] ..... A63F 3/00
(52) U.S. Cl. ..... 273/247; 273/259; 273/277
(58) Field of Search ..... 273/244, 247–259, 273/277, 287, 236, 242, 243

(56) References Cited

U.S. PATENT DOCUMENTS 3,833,220 A * 9/1974 Schurdell
3,995,863 A * 12/1976 Cummins
4,003,580 A * 1/1977 Haffey
4,094,509 A * 6/1978 Barron
4,173,346 A * 11/1979 Godwin
4,989,879 A * 2/1991 Nigh
5,158,301 A * 10/1992 Martukovich
5,217,229 A * 6/1993 Jaime
5,769,419 A * 6/1998 Hill

* cited by examiner

*Primary Examiner*—Benjamin H. Layno
*Assistant Examiner*—Vishu Mendiratta
(74) *Attorney, Agent, or Firm*—Paul H. Gallagher

(57) ABSTRACT

A board having yard markings representing a football field, with a hole at each yard marking, for detachably insertion of pins representing the scrimmage line, and the 10-yard line from the scrimmage line. Dice are rolled for determining the kind of play and the yardage gained or lost. The dice are in groups each containing more than one die; all to the dice in each groups are of the same color, but those in the different groups are of different colors. Game includes rules for determining the plays, the selection of plays, when there is a choice, and the score thereof.

5 Claims, 2 Drawing Sheets

BOARD GAME

FIELD OF THE INVENTION

The invention resides in the field of board games of the general kind that includes a board with a field of play, and separate pieces moved on the board according to predetermined rules and instructions that include an element of random plays.

SUMMARY OF THE INVENTION

The game is patterned after a football game, and includes representations or indications of the playing field, football, yard markers, scrimmage lines, goal lines, goals.

Gains and losses are determined by rolling a plurality of dice.

Rules are provided for establishing the kind and extent of the plays according to the number of spots exposed on the dice that are rolled.

The extent of plays are measured by full-yard increments, thereby avoiding situations where the ball is located only partially past a yard line.

A condition is provided wherein, in certain instances, a play made can be cancelled or nullified by the opponent, after having been considered completed.

BRIEF DESCRIPTION OF THE INDIVIDUAL FIGURES OF THE DRAWINGS

FIG. 1 is a face view of the game board.

DETAILED DESCRIPTION OF THE DRAWINGS

Since the game is based on a football game, in the description below, reference to rules and plays in a football game may be interpreted to apply to this game.

Referring in detail to the drawings, FIG. 1 is a face view of the board 12 used in the game. This board is rigid and may be made of any suitable materials such as wood, plastic, etc. The board has a length dimension indicated at 14 and a width dimension indicated at 16.

Figure 3:
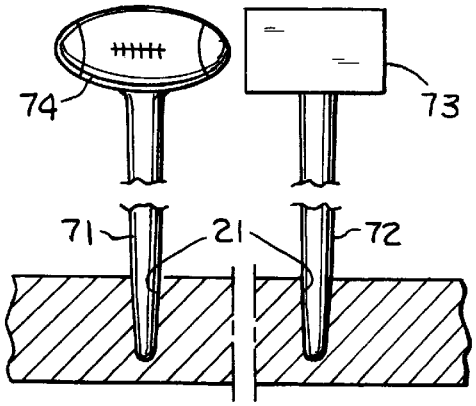
FIG. 3 is a large scale view, in section, taken at line 2—2 of FIG. 1, showing the marking pins and their positioning in the board.

At one side of the board is an index 18 representing a football field. The index includes markings 20 spaced along a line longitudinally of the board, these markings including holes 21 (see also FIG. 3) indicating 1-yard lines, and 10-yard lines 22 at corresponding holes.

The 10-yard lines and holes are numbered generically at 24, and the 50-yard line is also provided with a conspicuous indicator 26. The 35-yard lines are indicated by conspicuous indicators 28, these lines being the location of the ball for kicking off.

The football field includes a main playing field 32 and end zones 33 beyond the main playing field. End lines 34, 35 determine the ends, left and right, of the main playing field, being marked O and G respectively. These letters, O, G represent the 0 yard line, and Goal Line, being so marked to facilitate recognition of the ends of the playing board by the players who would be sitting at the same places at the board throughout the game, and avoid contusion by each player as to the direction of progress. Each player would recognize his own goal line, by the O or G markings, determined at the beginning of the game. In each end zone are additional holes 21 (see also FIG. 3) distributed transversely of the field for convenience, and for saving space on the board. These holes are ten in number and represent 1-yard lines. Marking lines 38 are placed at the first, fifth and tenth ones of these holes, for quick identification, and the innermost ones, designated 38', represent the goal posts and the limits of the end zones.

Mounted on the board are indicators 46, 48 representing which of the downs the offensive team is playing in, and the number of the quarter in the game, in which the playing is taking place. The indicators 46, 48 include swingable levers 50, 52, pivoted at 53 on the board, the levers having holes, 54, 56 for exposing the respective numerals 58, 60 therethrough when the levers are moved to the corresponding positions. The numerals 58, 60 are arranged in arcs about the pivots 53, and when a certain down or a certain quarter is then prevailing, the levers are swung to position over the corresponding numbers.

In the center of the board are columns 62, 64, 66, 68 of written information to be referred to below, in connection with the playing of the game.

Figure 2:
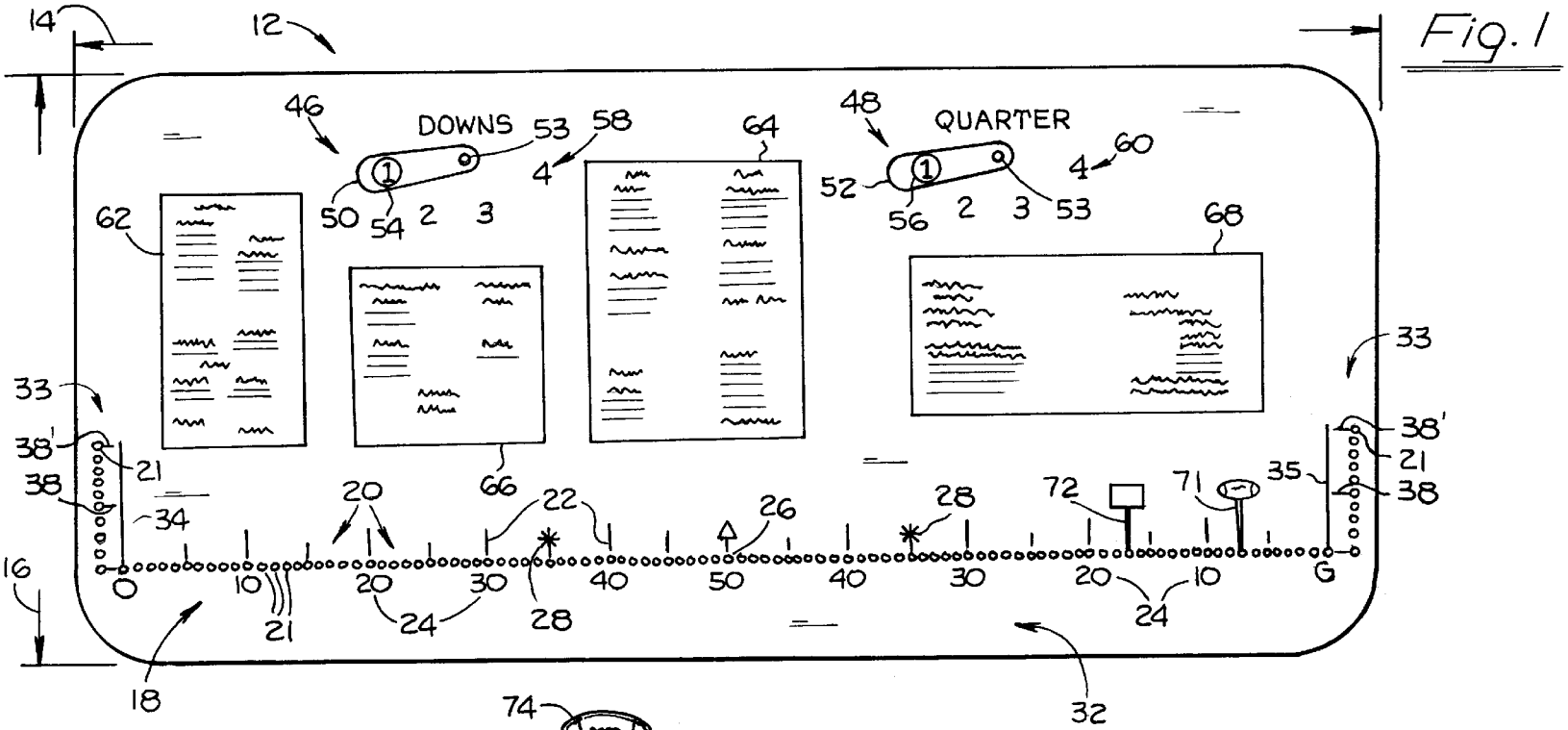
FIG. 2 is a large view of the marking pins utilized on the board.

The game includes marking pins 70 (FIG. 2) one of which, 71, is a scrimmage line marker or ball marker, and the other, 72, a 10-yard marker, or first down marker. These pins are inserted into the line marker holes 21 in the board for indicating steps in the plays as referred to below. The ball marker pin 71 has a knob 74 at the top in the shape of a football, representing the scrimmage line, and the position of the ball in an actual game.

The pin or marker 72 has a knob 73 at the top which may be of any desired shape, distinctive from the knob 74, to indicate the first down line relative to the scrimmage line. The knob 73 in the present case may be of square shape or other desired shape.

As noted above, the pins 71, 72 are be inserted selectively in any of the line holes 21. Assume for example that the line of scrimmage is the 7-yard line (FIG. 1) for the offensive team moving to the left, and therefore the ball marker pin 71 is inserted at the hole 21 in that line. In association therewith, the 10-yard pin 72 is inserted in the 17-yard hole. These pins are inserted not only in the holes in the main playing field but also those in the end zones, for the respective plays. The description of the plays will be referred to hereinbelow.

Figure 4:
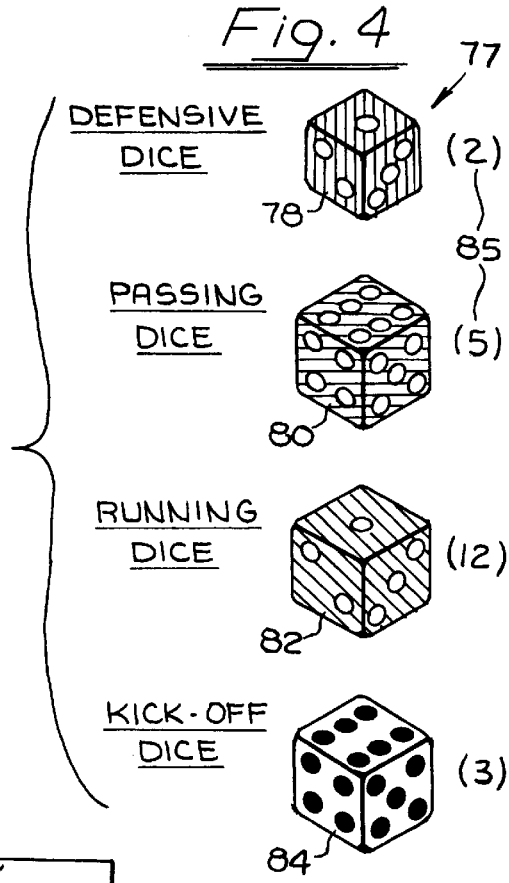
FIG. 4 is a view of the various dice used in playing the game.

FIG. 4 shows dice 77 used in the playing of the game. These dice are constituted by four groups 78, 80, 82, 84. This figure identifies the function of the dice of each group, and indicates at 85 the number of dice that are included in each group, it being noted that the groups are made up of different numbers. The dice of each group are all of the same color, but the colors of those in different groups are different. This figure shows, in shading, the actual colors of the dice used in this instance, the colors being very distinctive. They are arbitrarily selected, but preferably the defensive dice 78 are red. The dice of the different groups may be distinctive not only in different colors, but in different sizes as well. In the present case the dice 78 are smaller than the others.

Figure 5:
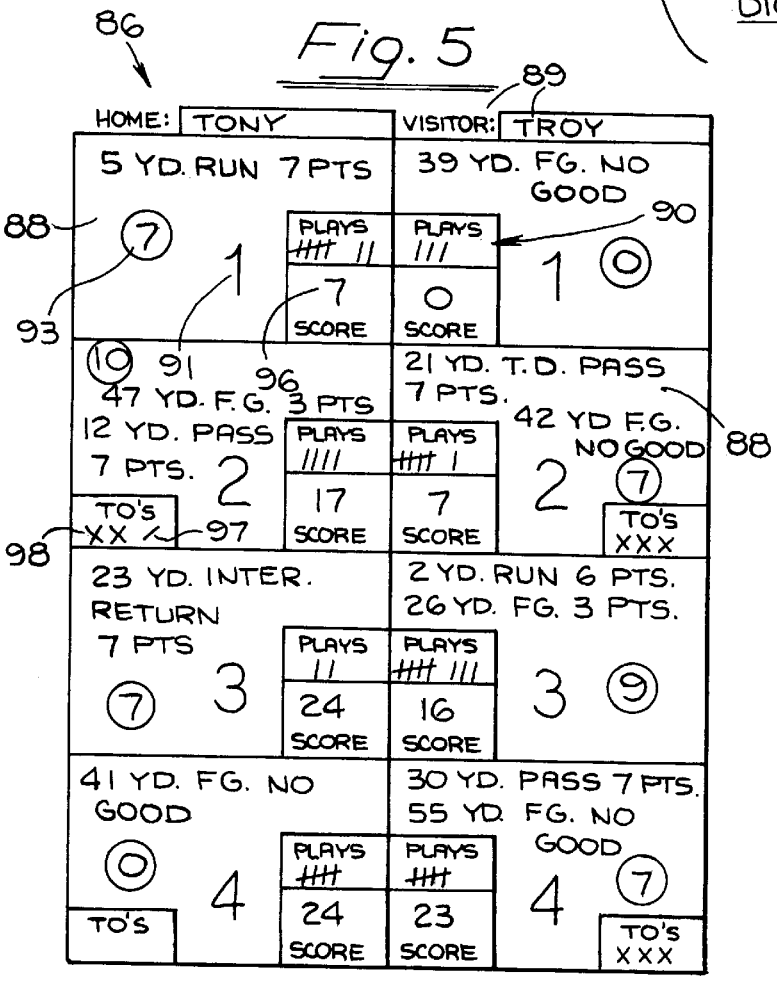
FIG. 5 is a face view of a score card.

A score card 86 is shown in FIG. 5. A space 88 is provided for insertion of scores made by plays such as: Touchdowns, Field Goals, Extra Points, or Safeties. One example is "21-yard Touchdown Pass, 7 points." The 7 points includes the extra point that was Good, and a 42-yard Field Goal that was No Good. Abbreviations are used to conserve space. The card bears permanent identification 89 of players or team.

In box 90, the plays are kept track of with a vertical line representing one play for each line, and a 5th play with a slash through the first tour vertical lines. Numeral 91 indicates Quarters of the game, for both the Home and Visitors Team. Space 88 also accommodates a finalized score 93 which shows the encircled number of Total Points scored in that quarter. Numeral 96 indicates the running Total Score for the game this being the Final Score at the end of the 4th Quarter. In a similar manner, a slash 97 is entered when a Time Out is called, and when such Time Out is completed, a back slash is made, forming an "X" as at 98.

This procedure is continued throughout the game, in all quarters for both players.

Figure 6:
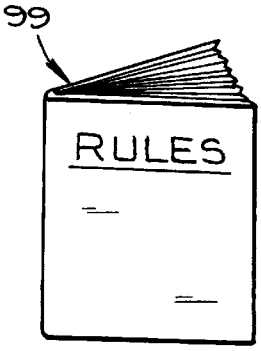
FIG. 6 is a perspective view of the rule book.

A rule book 99 (FIG. 6) contains the full rules of the game, as set out fully hereinbelow.

As a general statement of playing the game, the dice are rolled in each play according to the rules of the plays, and the exposed spots on the dice are added up. The added spots then indicate a particular play or the result achieved in that play. The total spots achievable are set out in the Dice Tally hereinbelow.

The added spots may be as few as 2, as in the case of the defensive dice, where there are only 2 dice, and each could expose the one spot thereon.

In contrast to the immediate foregoing, the greatest number of exposed spots could conceivably be 72, as in the case of the Running Dice 82, where there are 12 dice, and the six spot is exposed on every one.

The Dice Tally, set out below, includes all of the conceivable numbers between 2 and 72, and these, according to which of the dice groups are rolled, i.e. the Passing Dice, Running Dice, Kick Off Dice, Defensive Dice.

The columns and tables 62, 64, 66, 68 imprinted on the board are those shown in the Dice Tally.

The Dice Tally includes the details of the groups 62, 64, 66, 68. Within each group, are columns of exposed dice spots, at the left, representing plays, yardage, etc., followed by explanations of the items. In all cases, each line represents a single roll of the dice.

DICE TALLY
Group 62:

| a KICK OFF | b RETURN | c PUNT | d RETURN |
|---|---|---|---|
| 3 = 64 yds. | 2 = T-12 | 1 = T-21 | 1 = T-20 |
| 4 = 65 yds. | 3 = T-8 | 2 = T-10 | 2 = T-5 |
| 5 = 70 yds. | 4 = T-5 | 3 = T-10 | 3 = T-1 |
| 6 = 65 yds. | 5 = T-3 | 4 = T-10 | 4 = NO RETURN |
| 7 = 65 yds. | 6 = T-1 | 5 = T-16 | 5 = T-2 |
| 8 = 65 yds. | 7 = NO RETURN | 6 = T-18 | 6 = T-11 |
| 9 = 60 yds. | 8 = T-1 | | |
| 10 = 55 yds. | 9 = t-6 | | |
| 11 = 55 yds. | 10 = T-7 | | |
| 12 = 45 yds. | 11 = T-12 | | |
| 13 = 55 yds. | 12 = T-21 | | |
| 14 = 50 yds. | | | |
| 15 = 60 yds. | | | |
| 16 = 65 yds. | | | |
| 17 = 65 yds. | | | |
| 18 = 64 yds. | | | |

In Group 62, col. a: 3 dice (84) are rolled, and at the left, is the number of exposed spots on the dice rolled, and at the right, the number of yards the ball goes on the Kick Off in the corresponding roll. In col. b: The number of exposed spots in those 12 rolls show the yards returned. The expression "T-12" means the total of 12 dice to be rolled for yards returned. The greatest total that can be returned, in this case, would be 12×6, or 72. It the first total is "7", as indicated, there is no return. The greatest number of yards that could be achieved in a return would be 126 yards, as indicated in the last item.

In col. c and d in Group 62, the calculations are: Col. c. Punt and Col. d. Return. In the line at the left is the number of exposed spots in one roll and at the right is the number of dice to be rolled for the yardage the ball is to go.

End of Group 62

Continued on Next Page

Group 64:

| PASS a | RUN b |
|---|---|
| 5 = T.D. | 12 to 28 = T.D. |
| 6 = T.D. | 29 = T-20 |
| 7 = T.D. | 30 = T-17 |
| 8 = T.D. | 31 = T-15 |
| 9 = T-15 | 32 = T-8 |
| 10 = T-10 | 33 = T-3 |
| 11 = T-13 | 34 = T-1 |
| 12 = T-3 | 35 = FUMBLE |
| 13 = INCOMPLETE | 36 = T-1 |
| 14 = INCOMPLETE | 37 = T-1 LOSS |
| 15 = T-3 | 38 = T-1 |
| 16 = INCOMPLETE | 39 = T-1 |
| 17 = INCOMPLETE | 40 = T-2 LOSS |
| 18 = INCOMPLETE | 41 = T-1 |
| 19 = INCOMPLETE | 42 = T-1 LOSS |
| 20 = T-2 | 43 = T-2 |
| 21 = T-2 | 44 = T-1 LOSS |
| 22 = INTERCEPTION | 45 = T-1 |
| 23 = T-3 | 46 = T-3 |
| 24 = T-13 | 47 = T-1 LOSS |
| 25 = T-10 | 48 = T-1 |
| 26 = T-15 | 49 = T-3 |
| 27 = T.D. | 50 = T-4 |
| 28 = T.D. | 51 = T-5 |
| 29 = T.D. | 52 = T-10 |
| 30 = T.D. | 53 = T-11 |
| | 54 = T-12 |
| | 55 = T-13 |
| | 56 = T-20 |
| | 57 to 72 = T.D. |

In playing this phase, the offense chooses either "Pass" or "Run" and selects the corresponding dice 80 or 82. In the case of passing, as in col. a, the expression "T.D." represents a touchdown. In each case or the Pass plays, the roller gets a single roll of the dice. Also, in the lines including the descriptive words, only a single roll is permitted. In all the remaining items in col. a the calculations are as described in connection with Group 62.

In the case of Running, as in col. b or Group 64, the expression "T.D." stands for touchdown; other lines include "Fumble" or "Loss", and as to the remaining items, the calculations are as described in connection with Group 62.

End of Group 64.

Group 66:

| INTERCEPTION RETURN a | FUMBLE RETURN b | DEFENSE |
|---|---|---|
| 1 = T-3 | 1 = T-2 | Two dice: |
| 2 = T-2 | 2 = NO RETURN | Any pair stops |
| 3 = T-22 | 3 = T-1 | the play. |
| 4 = NO RETURN | 4 = T-21 | |
| 5 = T-6 | 5 = T-4 | |
| 6 = T-7 | 6 = T-3 | |

In cols. a and b in this group, certain items are identified as to the results achieved, and as to the remaining items, the calculations are as described in connection with Group 62.

In the step "Defense", the player uses two dice 78 (FIG. 4) and on any "Run" or "Pass" play, any pair of exposed spots stops the previous offensive play; with the exception of Extra Points . . . where no Defense is used.

End of Group 66.

Group 68:

EXTRA POINTS a

ONE POINT:

All but 4 is good.

TWO POINTS:

Start at 3 yard line.

Run or Pass; You must gain 4 yards or more to score the two points.

FIELD GOAL b

Inside the:

10=6 dice
20=9 dice
30=11 dice
40=13 dice
50=14 dice
60=15 dice
70=16 dice
80=17 dice Ball has to pass goal line by 11 yards to be good.

Col. a of this Group refers to points after Touchdown. Any two dice may be rolled for 1 point, and for 2 points, the start is at the 3 yard line, and the gain must be 4 yards or more, i.e., to pass the goal line.

Col. b of this Group determines the Field Goal possibilities. At the left are shown the positions where the Offense can kick, and at the right are indicated the numbers of dice that may be rolled at each position, and the exposed spots on those dice that are rolled, determine the number of yards gained. Also, as noted, in this step, a gain of 11 yards beyond the goal must be achieved, in line with the condition that an on-line, or partial line position are not recognized.

End of Group 68

Continued on Next Page

The following Rules of Play specify each of various steps to be taken and the results thereof.

INDEX TO RULES
(see following RULES OF PLAY)

| RULE | RULE NUMBER |
|---|---|
| Ball Marker | 1 |
| Defensive Play | 2 |
| Extra Points | 3 |
| Field Goals | 4 |
| First Down | 5 |
| First Down Marker | 6 |
| Fumble | 7 |
| Fumble Return | 8 |
| Interception | 9 |
| Interception Return | 10 |
| Kick Off | 11 |
| Kick Off Return | 12 |
| Offensive Play | 13 |
| Pass | 14 |
| Punts | 15 |
| Punt Return | 16 |
| Run | 17 |
| Safety | 18 |
| Scrimmage Line | 19 |
| Sudden Death | 20 |
| Time Outs | 21 |
| Touch Down | 22 |
| End Zone | 23 |
| The Play | 24 |

RULES OF PLAY

1=Ball Marker

The Ball Marker indicates the scrimmage line and the position of the ball. It is moved on yards gained or lost, Punts, Kick Offs, all Returns and Field Goals.

2=Defensive Play

When the Offense Runs or Passes; the Defense will roll 2 dice, and any pair stops the play for No Gain. There is no defensive play for the following: Interceptions, Fumbles, Field Goals, Extra Points, Loss of Yardage, Kick-offs, Punts and Returns.

3=Extra Points

One Point—Roll two dice. All but a total of 4 means the Extra Point is Good. A total of 4 means it is No Good.

Two Points—Start at the 3-yard line. Run or Pass: You must gain 4 yards or more to score the 2 points.

Extra Points are scored after Touchdowns, a choice of 1 point or 2 points is made by the team that scores the Touchdown.

4=Field Goals

Field Goals may be kicked at any time on 1st, 2nd, 3rd, or 4th down. It the Field Goal is missed, the ball returns to the line of Scrimmage—other teams ball. If it is Good, you get 3 points and then you Kick Off.

Example: It you are on the 33-yard line, you must roll 44 or better on the dice for the Field Goal to be Good. You get 13 dice to roll to do so. If it is not Good, the ball returns to the line of Scrimmage.

Example: It you are on the 9 yard line, that is, inside the 10 yard line, you roll 6 dice, you must roll a total of 20 or more for the Field Goal to be Good, that is the 9 yards plus 11 past the goal line. The ball always has to go 11 yards past the goal line to be Good.

5=First Down

Assume the Scrimmage line is the 21-yard line a 1st Down is made when you get to the 31-yard line or further. You will then get 4 new downs for a 1st Down.

6=First Down Marker

The 1st Down Marker will be set 10 yards ahead of the Ball Marker on 1st Down. When a 1st Down is accomplished the 1st Down Marker is again moved 10 yards ahead of the Ball Marker.

Example: The Ball Marker is on the 50-yard line, 1st Down Marker is placed on the 40-yard line.

7=Fumble

On a Running play, the 12 dice total is 35. That is a Fumble. The other team will get the ball and must roll Fumble Return.

8=Fumble Return

All Fumble Returns are from the scrimmage line. Example: One die is rolled, it you roll a 4, it is a total of 21 dice: that is a super Fumble Return.

9=Interception

On a pass play, your 5 dice total 22. It is an Interception. The other team gets the ball and must roll Interception Return.

10=Interception Return

All Interception Returns are returned from the line of Scrimmage.

Example: One die is rolled. It you roll a 5, you take the total of 6 dice for your return yardage.

11=Kick Off

You Kick Off to Start the game and after Touchdowns and Field Goals. You Kick Off from the 35 yard line. You roll 3 dice.

Example: It your total is 4; the ball goes 65 yards to the goal line or (0) yard line. The ball must be returned. See Kick Off Return. Another Example: It your total is 5, the ball goes 70 yards or 5 yards deep in the end zone. It is optional to return the ball. It you opt to return the ball and you do not get out of the end zone, it is a Safety. See Safety. It you opt not to return the ball, the ball is put on the 20 yard line.

12=Kick Off Return

Kick Off must be returned it the ball is kicked off and lands on the goal line or (0) yard line. It the ball lands in the end zone it is optional. You roil 2 dice for your return.

Example; It your total is 3, you roll a total of 8 dice, for your Return total.

13=Offensive Play

An Offensive Play is a play that you Run or Pass and is not Fumbled or Intercepted. All Offensive Plays are defended by a Defensive Play unless there is a Fumble, Interception or Loss of Yardage. It the Offensive Play is Fumbled or Intercepted, it does not count as an Offensive Play.

Remember; 10 Plays per quarter. 1 Offensive Play=1 Play.

14=Pass

You roll 5 dice. It your total is 8, for example it is a Touch Down. It your total is 9, that is the total of 15 dice, which is the number of yards gained on the pass. It your total is 10 on the first roll, that would be a total of 10 dice yards gained on the pass. It you would roll a 17, that would be an Incomplete pass. It you would roll a 22, that is an Interception and the other team gets the ball and must roll Interception Return.

See Interception Return.

15=Punts

One die is rolled.

Example: It you would roll a 2, your total punt yardage would be the total of 10 dice, from the Scrimmage line.

16=Punt Return

It is optional to return a Punt that lands in the End Zone. It you opt to return the ball and you do not get out of the End Zone, it is a Safety. See Safety.

It you opt not to return a ball that is in the End Zone, the ball is put on the 20-yard line. Otherwise: you roll one die. Remember: if you roll a 4, there is no return.

17=Run

You roll 12 dice. It your total for example is 12 to 28, it is a Touchdown. It your total would be 29, that would be 29=T-20, which means a total of 20 dice yards gained on the Run. It your total would be 35, that is a Fumble.

See Fumble. It your total would be 40, that would be 40=T-2 Loss or a total loss of 2 dice yards lost.

18=Safety

A Safety equals 2 points.

It a Kick Off or Punt goes into the End Zone, Returns are optional. It you elect to return while you are in the End Zone and you do not get to the goal line (0) yard line, or beyond, it is a "Safety". Another example would be, it you had the ball on the 6 yard line, and you choose to run, your total for your roll was 40, that would be 40=T-2 Loss, that reads as Total of 2 dice yards lost. It you then roll a 7, it would put you 1 yard deep in to the End Zone for a "Safety". When a Safety results, you must Punt or Kick Off from the 20 yard line, as you choose.

19=Scrimmage Line

The Scrimmage line is where the ball ends up after the Kick Off and Return. After that is established, the Scrimmage line is where the ball is before the play and the new Scrimmage line, is where the ball ends up after the play.

20=Sudden Death

Flip a coin, winner receives or Kicks Off at their option.

2 Time Outs per team.

10 plays per Sudden Death quarter.

First score wins. It no one scores, repeat coin flip and start Sudden Death over. Repeat till there is a winner.

21=Time Outs

Time Outs are used it you want to try to score when all the plays are used up. There are 3 Time Outs per Team per Half. A Time Out is a running play or passing play. Kick Offs, Punts, Field Goals, Kick Off Returns, Punt Returns, Extra Points, Safeties, Interceptions, Fumbles, Interception Returns and Fumble Returns are not counted as a Time Out. Either team may call a Time Out, and force the other team to do another play. It there is one Time Out remaining by either team, the game could continue depending on the opponents strategy. It a team calls a Time Out, that team must use that Time Out on the next play by either team.

** See The Play.

22=Touchdown

You must cross the Goal Line to score a Touchdown. It you are on the goal line (0) yard line you are not in!!! 6 Points for a Touchdown plus Extra Point. See Extra Points.

23=End Zone

Is the 10 yards past the goal line or (0) yard line.

24=The Play

Roll one die. High die gets choice Kick or Receive in 1st Half. In the 2nd Half, other team has choice to Kick or Receive.

There are 4 quarters to the game.

Each Quarter has 10 Offensive Plays, both teams combined.

Example: Home 6 plays & Visitors 4 plays, equals 10 Plays.

Keep track of plays on score sheet.

3 Time Outs per Half per team.

One Play is a Run or a Pass that is not Fumbled or Intercepted.

All Kick Offs, Punts, Field Goals, Kick Off Returns, Punt Returns, Extra Points, Safeties, Interceptions, Fumbles, Interception Returns and Fumble Returns are not counted as Plays.

4 downs to get a First Down. Punt or Kick a Field Goal on any down. First Down gives you tour new downs.

First Half

After 10 Plays the First Quarter Ends.

After 10 more Plays the Second Quarter Ends, unless Time Outs are used.

Second Half

After 10 Plays the Third Quarter Ends.

After 10 more Plays the game Ends, unless the

24=The Play (cont.)

Time Outs are going to be used.

** Remember:

One Time Out equals One Play.

One Play is a Pass or a Run that is not Fumbled or Intercepted.

You may Kick a Field Goal or Punt as long as you have one Time Out remaining, without using that time out, forcing the other team to continue the game to complete your TIME OUT. When calling a Time Out, put a slash in your Time Out box. When your Time Out is completed, a backslash is used to form an "X". You do not use a complete Time Out on a Fumble, Interception, Field Goal or Punt. At some time, by a Run or a Pass that is not Fumbled or Intercepted, a Time Out is completed.

What is claimed is:

1. A board game comprising a board simulating a football field on which football games are played, the board being rectangular and elongated and having ends and sides, the board having a main playing field thereon of less length and width than the corresponding dimensions of the board, the board having goal lines at the ends of the main playing field, and end zones between the ends of the main playing field and the ends of the board respectively, the board having markings representing transverse yard lines spaced lengthwise of the field, a ball marker pin for indicating the location of a football, a 10-yard marker pin for indicating a ten yard limit constituting a distance which a predetermined number of plays must achieve, the board having holes in a line extending longitudinally of the board located adjacent at least one side of the main playing field and spaced apart at intervals representing 1-yard spacing of the transverse yard lines of the main playing field, the board having yard lines in each end zone extending longitudinally of the board and spaced apart transversely, the board having holes adjacent the lines in the end zones respectively.

all of the holes being capable of releasably receiving any of the marker pins, the game including dice for use by the players for determining the number of points obtained by each player, the yard lines in the end zones and those in the main playing field being equally spaced apart and when added together determining the score of a play made by a player, whereby the game is capable of accommodating points of each player greater or less than the number of transverse yard lines in the main playing field.

2. A board game according to claim 1, wherein the ball marker pin has a knob in the shape of a football, and the 10-yard marker pin has a knob with a distinctively different shape from that of a football.

3. A board game according to claim 1, wherein, the board has markings "O" and "G" adjacent the goal lines respectively.

4. A board game according to claim 1, wherein, the dice include a plurality of groups, the dice in each group are identical with each other, and the dice of each group are different from the dice in all the other groups in both size and color.

5. A board game according to claim 1, wherein, all of the dice have markings, only identical dark spots.

* * * * *